United States Patent [19]

Karlsson

[11] 4,139,722

[45] Feb. 13, 1979

[54] ELECTRIC INDUCTION HEATING FURNACE

[75] Inventor: Gösta Karlsson, Vësterås, Sweden

[73] Assignee: ASEA Aktiebolag, Vësterås, Sweden

[21] Appl. No.: 811,878

[22] Filed: Jun. 30, 1977

[30] Foreign Application Priority Data

Jul. 5, 1976 [SE] Sweden ..... 7607666

[51] Int. Cl.[2] ..... H05B 11/00

[52] U.S. Cl. ..... 13/4

[58] Field of Search ..... 13/2, 4, 9 ES, 9, 26, 13/27

[56] References Cited

U.S. PATENT DOCUMENTS 3,759,311 9/1973 Jackson ..... 13/9 ES X

FOREIGN PATENT DOCUMENTS 432712 7/1935 United Kingdom ..... 13/4

*Primary Examiner*—R. N. Envall, Jr.

*Attorney, Agent, or Firm*—Kenyon & Kenyon, Reilly, Carr & Chapin

[57] ABSTRACT

An electric induction heating furnace comprises a crucible having a lower portion for containing a melt and an upper portion for containing slag floating on the melt. The lower portion is surrounded by an electric induction coil below the top of the lower portion and therefore the upper surface of the melt so that the melt can be inductively heated while its upper surface remains relatively quiet to provide a favorable condition for treatment of the melt by the slag. The crucible's upper portion containing the slag has an inside that is electrically conductive and an arcing electrode is positioned above the slag so that arcing power can be applied via that inside and the electrode to an electric arc formed by the electrode with the slag, for heating the slag to prevent its temperature from dropping too low to permit easy deslagging.

1 Claim, 1 Drawing Figure

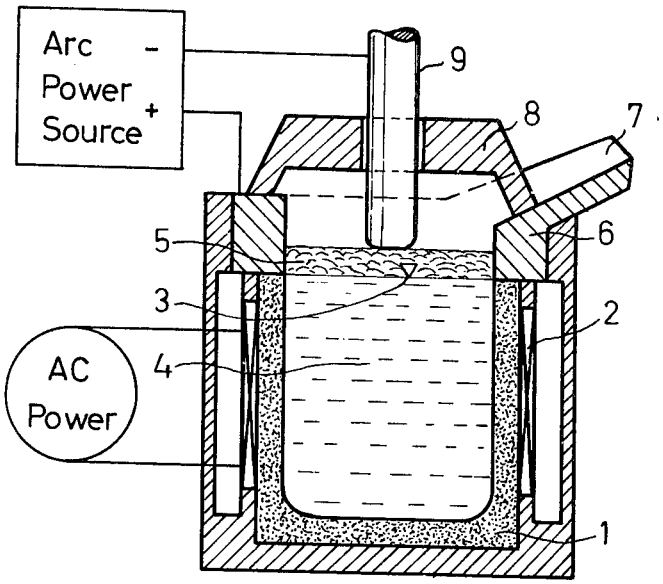
Arc
Power
Source
-
+
9
8
7
6
5
3
2
AC
Power
4
1

ELECTRIC INDUCTION HEATING FURNACE

BACKGROUND OF THE INVENTION

Crucible-type electric induction heating furnaces are used for melting iron and iron alloys to a melt with a treating slag floating on the melt. Such a furnace has an electrically non-conductive or non-magnetic crucible surrounded by an induction coil powered by AC current, the magnetic field of the coil inducing electric currents in the melt which is heated by its electric resistance to those currents. If the AC power is high frequency, the crucible is electrically non-conductive, and if low frequency, the crucible is non-magnetic.

In addition to heating, the induced currents in the melt exert a strong motor effect upon the melt having the advantageous effect of mixing the melt. On the other hand, if an oxidizing or reducing slag is floating on the melt for treating the latter, the motor effect forms eddies giving the surface of the melt a convex surface which is not a favorable condition for treatment of the melt by the slag, which is a disadvantage.

To avoid the above disadvantage, the electric power supplied to the induction coil can be reduced or the coil can be reduced in height so that its top is sufficiently far below the melt level to avoid material disturbances there interfering with the slag treatment. This results in the slag being heated only by conduction from the melt and introducing the risk that the slag does not receive sufficient heating to keep its viscosity low enough to avoid problems concerning deslagging.

In connection with the above, it is to be understood that an electric induction furnace of the crucible type is ordinarily a tilting furnace having a pouring spout and possibly a deslagging port so that by tilting the furnace deslagging and ultimate pouring of the melt can be carried out.

SUMMARY OF THE INVENTION

To obtain the advantage without the disadvantage referred to above, the present invention provides an electric induction furnace of the crucible type made with a crucible having a lower, electrically non-conductive or non-magnetic portion for containing the melt, and an upper portion for containing the slag floating on the melt. The lower portion is surrounded by an electric induction coil with the top of the coil below the top of the lower portion and therefore below the top level of the melt contained by this lower portion. The upper portion containing only the slag, has an electrically conductive inside and an arcing electrode positioned above the slag, so that arcing power can be supplied via that inside, the slag and the electrode, with an arc formed between the electrode and the slag.

When the coil is powered by AC, the melt is inductively heated without the motor effect causing any substantial disturbance of the top level of the melt, while the slag in the upper portion of the crucible can be heated by the electric arc to keep its temperature high enough for the slag viscosity to be low enough for easy deslagging when required. The arc power is carried mainly by the slag and not to any great extent by the melt.

It follows that during the heating of the melt its top level on which the slag floats can be kept relatively quiescent, certainly free from an appreciable convex surface, and therefore in a favorable condition for slag treatment, while the slag can be heated without relying on conduction from the melt.

BRIEF DESCRIPTION OF THE DRAWING

The accompanying drawing schematically illustrates the principles of the present invention by a representation of the components of the new furnace, shown in vertical section.

DETAILED DESCRIPTION OF THE INVENTION

In the above drawing the crucible lower portion 1 is shown with its surrounding induction coil 2 short enough so that it upwardly terminates below the level 3 of the melt 4 which is shown as reaching to the top of the crucible portion 1. To this extent, prior art induction furnace designs may be used. If the induction coil is powered by high frequency AC of possibly from 500 to 1,000 Hz, the crucible should be of electrically non-conductive construction to avoid induced currents in the crucible construction; in the case of low frequencies of from 50 to 60 Hz, the crucible construction should be non-magnetic. The induction coil may be provided with an iron core and yolk construction as usual. The important thing is that the top of the induction coil and its iron parts should not reach up so close to the melt level 3 that the currents induced in the melt disturb that level to a degree unfavorable to slag treatment.

The slag 5 is shown floating on the melt's top level 3 and this slag may be relatively thick, the volume of slag per ton of melt being often considerable. Conventionally this slag layer 5 is heated only by conduction from the melt 4 which is receiving its heat input necessarily some distance below the melt level 3 so as to avoid appreciable disturbances of the level 3.

With the present invention this slag layer 5 is contained by the upper portion 6 of the crucible which may also be regarded as an upward extension of the crucible proper. This upper portion, extension, or slag container 6 may be made entirely of silicone carbide, although for economy it can only be lined with silicone carbide and the silicone carbide may possibly be mixed with carbon. The silicone carbide with its possible carbon may be formed as required by powdered metal metallurgical techniques, being either formed as a lining or made into bricks with which the upper portion 6 is lined. The purpose is to make the upper portion 6 with an electrically conductive inside having adequate refractory properties.

This upper portion 6 is shown as having the pouring spout 7 and a top closed by a roof 8 down through which an electric arcing electrode 9 is positioned. Although it is not illustrated, it is to be understood that in the conventional way the entire furnace can be tilted, the roof 8 can be lifted, and the electrode 9 can be fed downwardly and upwardly, as in the case of an electric arc furnace of conventional construction.

The arcing power is supplied from a suitable power source via the conductive inside of the upper portion 6 and the electrode 9 via the molten electrically conductive slag. In the drawing a DC power source is shown with the slag 5 forming the anode and the electrode the cathode, this assuring a quieter arc and less electrode wear, assuming a normal graphite electrode is involved. However, the arcing power could be single phase AC. More than one of the electrodes 9 could be used and it is possible to use three electrodes powered by multiphase AC. In all cases this circuit is through the conductive inside of the upper portion 6, the slag 5 and via the arc, the electrode. Incidentally, the drawing shows the electrode 9 in the act of starting to draw the arc, the electrode being raised after the arc is struck, as required to maintain a proper arc. The slag 5 is adequately electrically conductive when molten.

The lower and upper parts of this new furnace can be made integral. The lower part 1 and the induction coil 2 may follow conventional crucible-type induction furnace construction as previously indicated. The upper or slag containing part or upper portion 6 can incorporate conventional furnace design techniques excepting for the requirement of electrical conductivity as to the inside of the portion 6 at least. As previously indicated, the roof 8 and electrode 9 can follow conventional electric furnace design with the understanding that the heating capacity of the arc need only be great enough to maintain adequate fluidity of the slag 5; the heating requirement is small as compared to that required for heating the melt in the case of an electric arc furnace.

In operation the crucible or lower portion, if 1 and 6 are considered as one crucible, is charged with, for example, steel pieces, in the same manner as any induction furnace, with the charge proportioned so that after meltdown, the level 3 is established far enough above the top of the induction coil 2 to prevent the latter inducing eddies in the melt appreciably disturbing the level 3. It would be possible for the coil 2, inducing the usual core and yokes to extend up to the level 3, but this would require the power supplied to the coil to be low enough to avoid unduly disturbing the level 3.

In any event, if the melt level 3 is not to be unduly disturbed, the slag layer 5, formed possibly by additions to the crucible for treatment of the melt, would normally be heated by conduction from the melt. This slag layer can be quite thick; the slag layer in volume may be 350 liters per ton of melt. If heated by conduction from the melt only, the risk of high slag viscosity and possibly even slag freezing inherently results.

As the slag layer 5 forms or is formed, the power is applied to the conductive inside of the upper portion or extension 6 and the electrode 9, the roof 8 and electrode being in the position shown by the drawing at that time. The arc is drawn and the slag 5 is heated as required to maintain a desirable slag viscosity. The power applied to the arc is only that required to heat the slag, it being, of course, unnecessary for the arc to heat the melt 4. Therefore, the arc power need not be so high as to blow away the slag layer 5 at the foot of the arc in the fashion experienced in the case of an electric arc furnace.

When the slag treatment is completed, the arc power is terminated, the roof 8 and electrode 9 are lifted and the crucible tilted to pour the slag and then the melt via the spout 7.

What is claimed is:

1. An electric induction furnace for heating a melt having a melt treatment slag floating thereon, said furnace comprising a crucible having a lower portion for containing the melt and surrounded by an induction coil that is reduced in height relative to said lower portion so that the coil's top is below the melt's level to avoid substantial disturbances there interfering with treatment of the melt by the slag floating thereon, said crucible having an internally electrically conductive upper portion extending upwardly from said lower portion for containing the slag floating on the melt's substantially undisturbed level, and an arcing electrode positioned above the upper slag level and connected with an electric power source via said internally conductive upper portion so as to form an arc heating the slag to maintain its fluidity while floating on the melt's substantially undisturbed level.

* * * * *

UNITED STATES PATENT AND TRADEMARK OFFICE

CERTIFICATE OF CORRECTION

PATENT NO. : 4,139,722

DATED : February 13, 1979

INVENTOR(S) : Gösta Karlsson

It is certified that error appears in the above–identified patent and that said Letters Patent are hereby corrected as shown below:

Column 3, line 28, change "inducing" to --including--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*